US005176435A

United States Patent [19]

Pipkens

[11] Patent Number: 5,176,435

[45] Date of Patent: Jan. 5, 1993

[54] INTERCHANGEABLE MODULAR FURNITURE SYSTEM

[75] Inventor: Donald R. Pipkens, St. Charles County, Mo.

[73] Assignee: Interchangeable Design Systems, Inc., St. Charles, Mo.

[21] Appl. No.: 615,157

[22] Filed: Nov. 19, 1990

[51] Int. Cl.[5] ..... A47B 96/20

[52] U.S. Cl. ..... 312/204; 312/265.6

[58] Field of Search ..... 312/107, 108, 111, 257.1, 312/267, 265.5, 265.6, 263, 105, 668, 194, 195, 204; 108/90

[56] References Cited

U.S. PATENT DOCUMENTS

| | | | |
|---|---|---|---|
| 194,890 | 9/1877 | Camp et al. | 312/111 |
| 1,602,383 | 10/1926 | Andersson | 312/111 |
| 3,211,507 | 10/1965 | Gamst | 312/107 X |
| 3,510,187 | 5/1970 | Schreyer | 312/194 X |
| 3,848,942 | 11/1972 | Fanini | 312/263 X |
| 3,851,936 | 12/1974 | Muller | 312/108 |
| 3,883,196 | 5/1975 | Mohr et al. | 312/194 |
| 4,201,428 | 5/1980 | Johnson | 312/111 |

*Primary Examiner*—Peter R. Brown

*Attorney, Agent, or Firm*—Polster, Lieder, Woodruff & Lucchesi

[57] ABSTRACT

An interchangeable modular furniture system is disclosed as including an underlying supporting structure having at least spaced side walls and a top wall with panels independently and removably mounted to at least one of the walls of the underlying supporting structure. Preferably, independently and removably mounted panels cover at least the spaced side walls and top wall of the underlying supporting structure. Cooperative releasable fasteners are attached to each panel and associated wall for releasable attachment to each other. The underlying supporting structure further includes a base having an underlying ledge adjacent each of the spaced side walls for also supporting the removable panels relative to the spaced side walls. Within the underlying supporting structure, shelves, drawers and/or doors may be employed in order to produce various types of furniture units including credenzas, dressers and dressers/cabinets. In addition, the aforementioned structure can be usefully employed for bars, desks, nightstands and other furniture pieces. The present invention also includes a modular bed system including an underlying mattress supporting structure and a headboard removably mounted relative to the underlying mattress supporting structure or to an adjacent wall, as may be desired.

28 Claims, 8 Drawing Sheets

INTERCHANGEABLE MODULAR FURNITURE SYSTEM

BACKGROUND OF THE INVENTION

The present invention relates to modular furniture systems, and more particularly, to an interchangeable modular furniture system including an underlying supporting structure having at least spaced side walls and a top wall with panel means independently and removably mounted to at least one of the walls of the underlying supporting structure, and preferably to at least the spaced side walls and top wall thereof, in order to provide an interchangeable modular furniture design system.

Most hotels and motels are constantly plagued with costly repair and/or replacement of laminated and/or wood furniture due to guest and employee abuse. Normal abuse is caused by guest and employee mishandling or mistreatment of the furniture. In this regard, it is well known that people do not take as good as care of property belonging to others, as they do with property belonging to themselves. Thus, in hotel and motel suites, furniture can be quickly and easily damaged by careless or intentional damage to laminated and/or wood furniture units.

Other less obvious abuse, which can be even more serious in some cases, is caused by water damage to such furniture. This results from two different causes. One type of water damage results from guests leaving ice containers on the furniture, which condenses and exposes the wood finishes and the laminated and wood furniture to extended dampness. Guests can cause less serious damage by water spilled from water glasses and the like. The second type of water damage, which can result in serious furniture abuse, is caused by water being directly thrown onto the furniture during carpet cleaning by employees or by simply allowing the furniture to remain on water cleaned carpets. In all of the aforementioned water damage cases, water can cause the laminated or wood furniture to expand and separate. In addition, laminated furniture uses particle board which can crack and break off, whereas with wood furniture, cracks, splitting and other unsightly conditions can occur.

There are other conditions which can cause damage to laminated and wood furniture. Changes in temperature, pressure and humidity, when shipping furniture to different geographical areas, can also cause swelling and expansion of furniture parts or components, resulting in extensive damage.

Repair of laminated or wood furniture typically takes several weeks or more, with consequent loss of use of the room during the repair period. Of course, the damaged furniture could be replaced, but replacement costs can be prohibitive.

As can be seen from the foregoing, a serious long term and unsolved problem has plagued the furniture industry, particularly the hotel and motel industry, but also in other commercial and industrial environments, as well as in residential use.

From the discussion that follows, it will be seen that the present invention answers this long standing problem of the prior art in a novel and unique solution for a variety of different types of furniture pieces including credenzas, triple dressers, triple dressers/cabinets, desks, nightstands, bars, beds and a variety of other furniture pieces, all of which will be explained in detail below.

SUMMARY OF THE INVENTION

Accordingly, among the several objects and advantages of the present invention include:

The provision of a new and improved interchangeable modular furniture system or construction which overcomes the deficiencies of the prior art and the long standing problems in the furniture industry;

The provision of the aforementioned interchangeable modular furniture system or construction which provides an interchangeable furniture design system or construction;

The provision of the aforementioned interchangeable modular furniture system or construction which enables one or more panels to be independently and removably mounted to an underlying supporting structure;

The provision of the aforementioned interchangeable modular furniture system or construction which affords a simple, efficient and economic solution for repairing or replacing damaged laminated and/or wood furniture;

The provision of the aforementioned interchangeable modular furniture system or construction which enable damaged furniture panels to be quickly and easily replaced with no loss of down time in the use of such furniture for hotel or motel rooms or for other purposes;

The provision of the aforementioned interchangeable modular furniture system or construction which eliminates damage replacement costs, reduces repair costs and reduces maintenance manpower costs;

The provision of the aforementioned interchangeable modular furniture system or construction which enables an owner/user to change the overall design and appearance of a furniture unit, without replacing the entire unit; and The provision of the aforementioned interchangeable modular furniture system or construction which can be used on a variety of different types of furniture pieces including credenzas, triple dressers, triple dressers/-cabinets, desks, nightstands, bars, beds and a variety of other furniture pieces.

Briefly stated, a modular furniture system of the present invention includes an underlying supporting structure having at least spaced side walls and a top wall, and panel means independently mounted to at least one of the walls of the underlying supporting structure. The panel means may include a single panel or a series of panel sections covering one or more of the walls of the underlying supporting structure. The panel means is also removably mounted to its associated wall for removal and replacement thereof. Preferably, the removable independently mounted panels cover at least the spaced side walls and top wall of the underlying supporting structure.

The underlying supporting structure may further include a supporting base interconnected to the spaced side walls, the base also having an underlying ledge adjacent each spaced side wall for supporting the removable panels relative to the spaced side walls.

The underlying supporting structure may include a rear wall and an open front opposing the rear wall with at least one interior wall extending between the rear wall and open front. This enables various types of supporting means, between the at least one interior wall and the spaced side walls, for supporting and storing various objects within the underlying supporting structure. Such supporting means may include supporting shelves mounted between the at least one interior wall and spaced side walls. In the same manner, drawers or drawers and pivoting doors or pivoting doors alone may be mounted between the at least one interior wall and spaced side walls. Thus, either credenzas or dressers or dressers/cabinets may be constructed.

In a different furniture design for bars and the like, the underlying supporting structure may include a front wall and an open rear wall opposing the front wall with a removable panel independently mounted to the front wall of the underlying supporting structure.

In still another design, the underlying supporting structure may include at least two spaced pairs of spaced side wall sections interconnected by a top wall extending therebetween, with a rear wall for each pair of side wall sections, and an open wall opposing each of the rear walls. Such a construction is useful in constructing a modular furniture desk enabling drawers to be mounted within the open walls of each pair of spaced side sections and with removable panels mounted to the side and rear walls each pair of spaced side wall section having a removable panel. Removable panel sections may also be mounted to an outer face of each of the drawers.

When removably mounting the panels or panel sections to the walls and underlying supporting structure, cooperating releasable fastening means are employed which may include hook and slot fastener elements arranged in cooperating pairs. Such construction may include laterally and longitudinally spaced pairs of hook and slot fastener elements.

Another type of cooperating releasable fastening means includes cooperating elongated elements provided on associated panels and walls which are constructed for overlapping and mating interlocking engagement when engaged with one another. Such cooperating elongated elements may be arranged in pairs of cooperating elongated elements provided on such panels and walls.

The present invention further includes a modular bed system including an underlying mattress supporting structure and a headboard removably mounted relative to the underlying mattress supporting structure or to an adjacent wall. The headboard may be removably mounted relative to the adjacent wall and positioned in close proximity to the underlying mattress supporting structure or the headboard may be removably mounted to the underlying mattress supporting structure and then positioned in close proximity to the adjacent wall.

These and other objects and advantages of the present invention will become more apparent from the description that follows.

BRIEF DESCRIPTION OF THE DRAWINGS

In the drawings.

Corresponding reference numerals will be used throughout the several figures of the drawings.

DESCRIPTION OF THE PREFERRED EMBODIMENT

The following detailed description illustrates the invention by way of example and not by way of limitation. This description will clearly enable one skilled in the art to make and use the invention, and describes several embodiments, adaptions, variations, alternatives and uses of the invention, including what I presently believe is the best mode of carrying our the invention.

Figure 13:
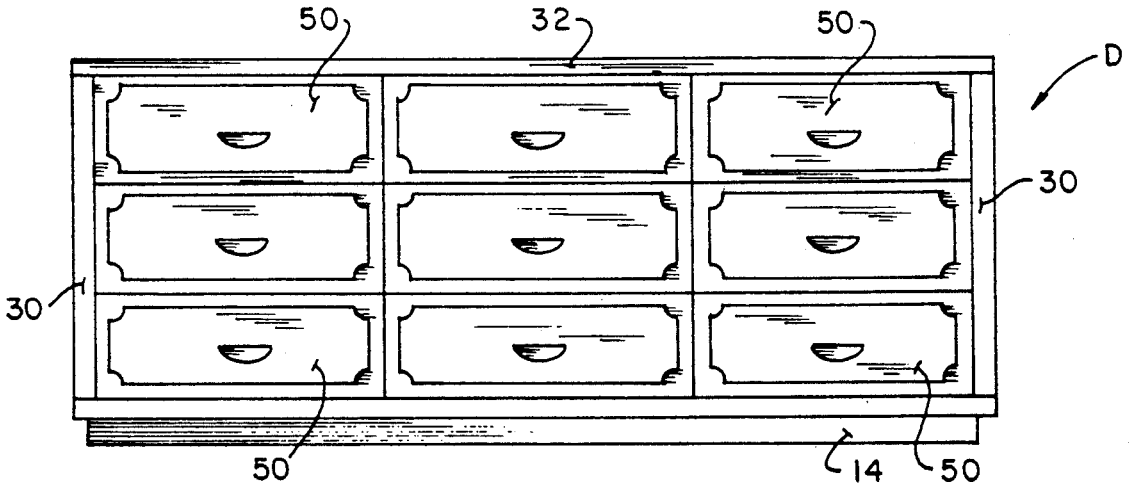
FIG. 13 is a front elevational view showing how a triple dresser unit can be constructed from the underlying supporting structure shown in FIG. 2 of the drawings.
Figure 14:
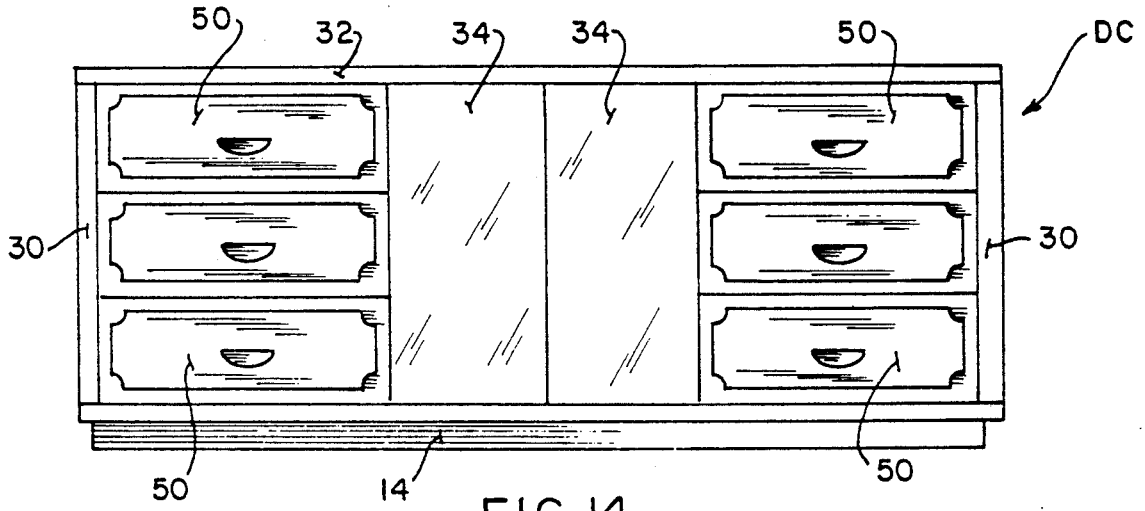
FIG. 14 is a front combination dresser/cabinet which can be formed from the underlying supporting structure illustrated in FIG. 2 of the drawings.
Figure 18:
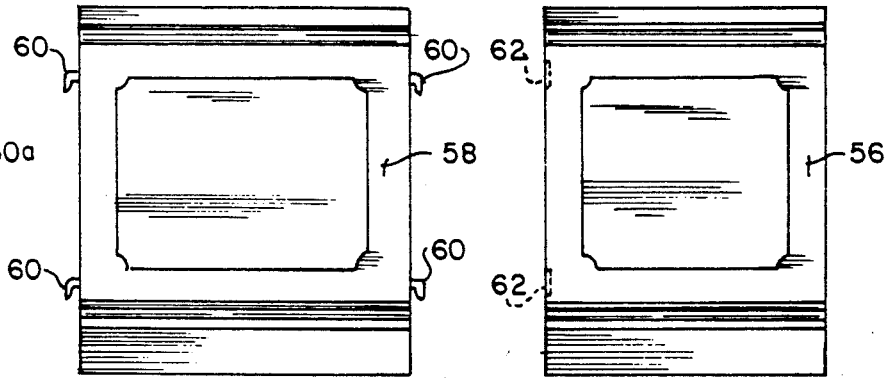
FIG. 18 is a rear elevational view of the panels attached to the outside front of a desk, as illustrated in FIG. 16, with the interchangeable design features of the present invention.
Figure 19:
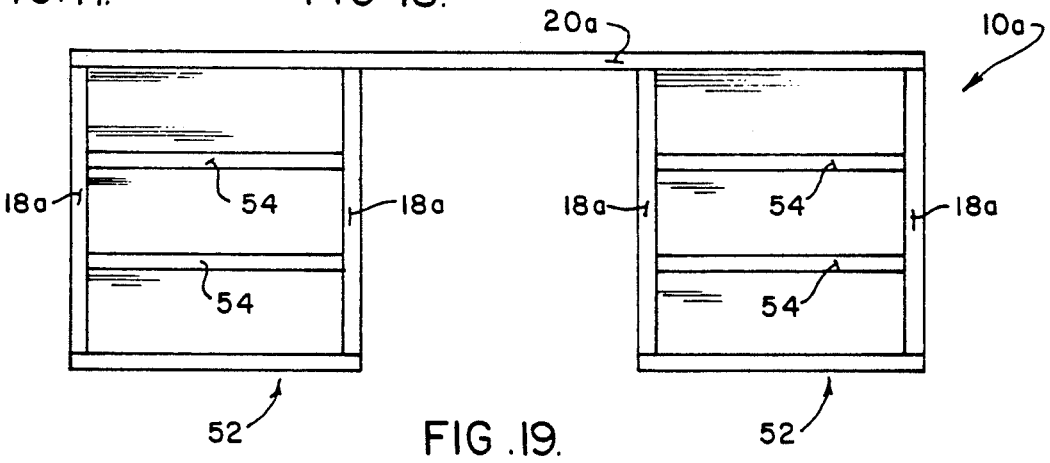
FIG. 19 is a front elevational view of the desk underlying supporting structure for use in constructing the desk illustrated in FIG. 16 of the drawings.
Figure 20:
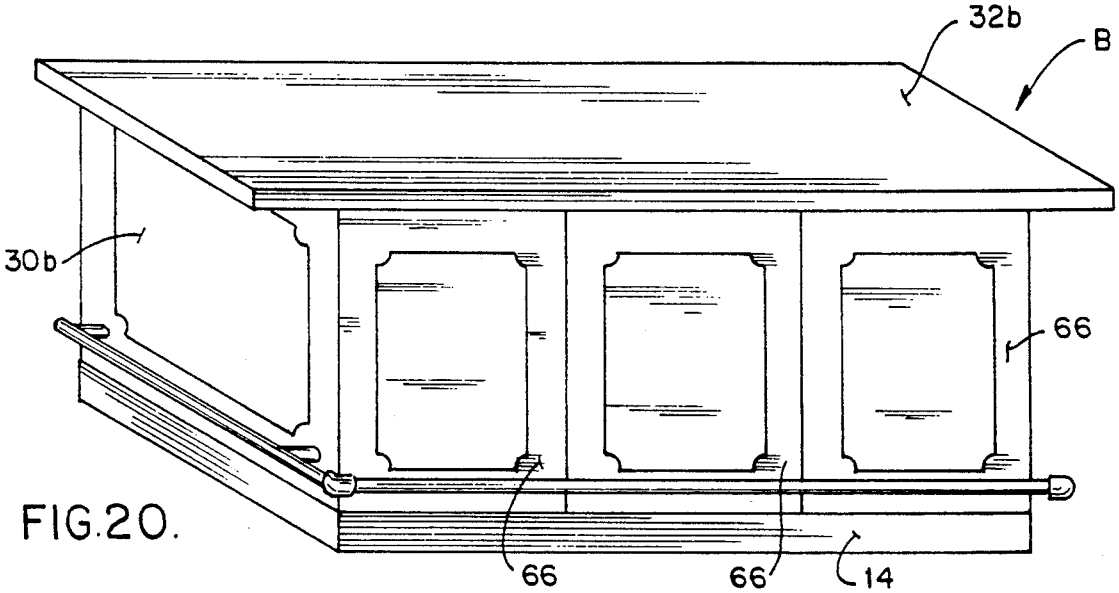
FIG. 20 is a front perspective view of a bar unit constructed with the interchangeable design features of the present invention.
Figure 21:
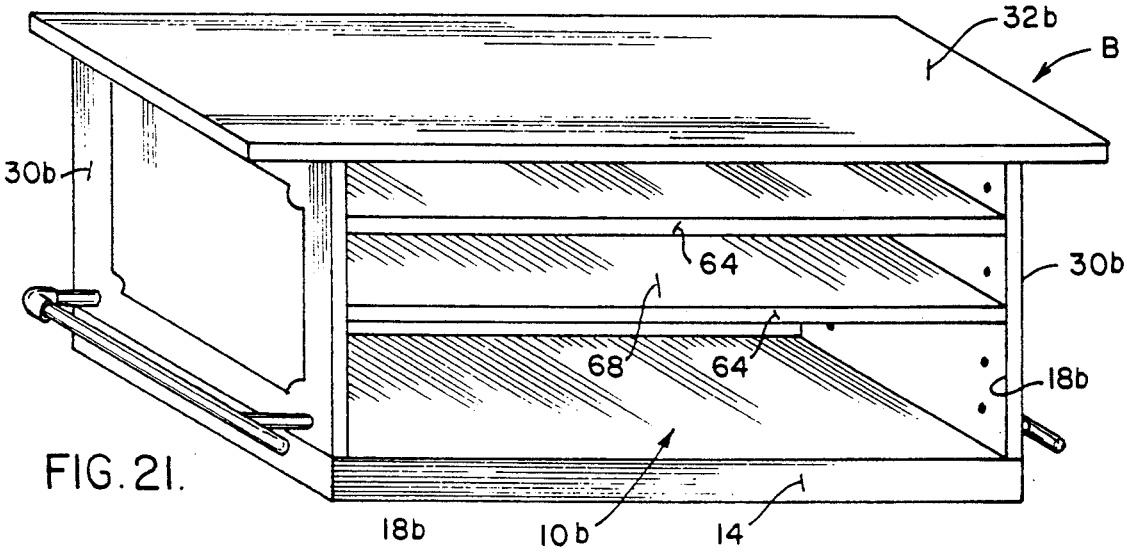
FIG. 21 is a rear perspective view of the bar unit shown in FIG. 20.
Figure 22:
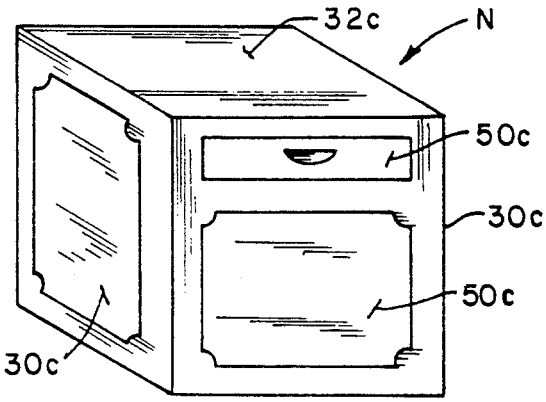
FIG. 22 is a front perspective view of a night stand with the interchangeable design features of the present invention.
Figure 23:
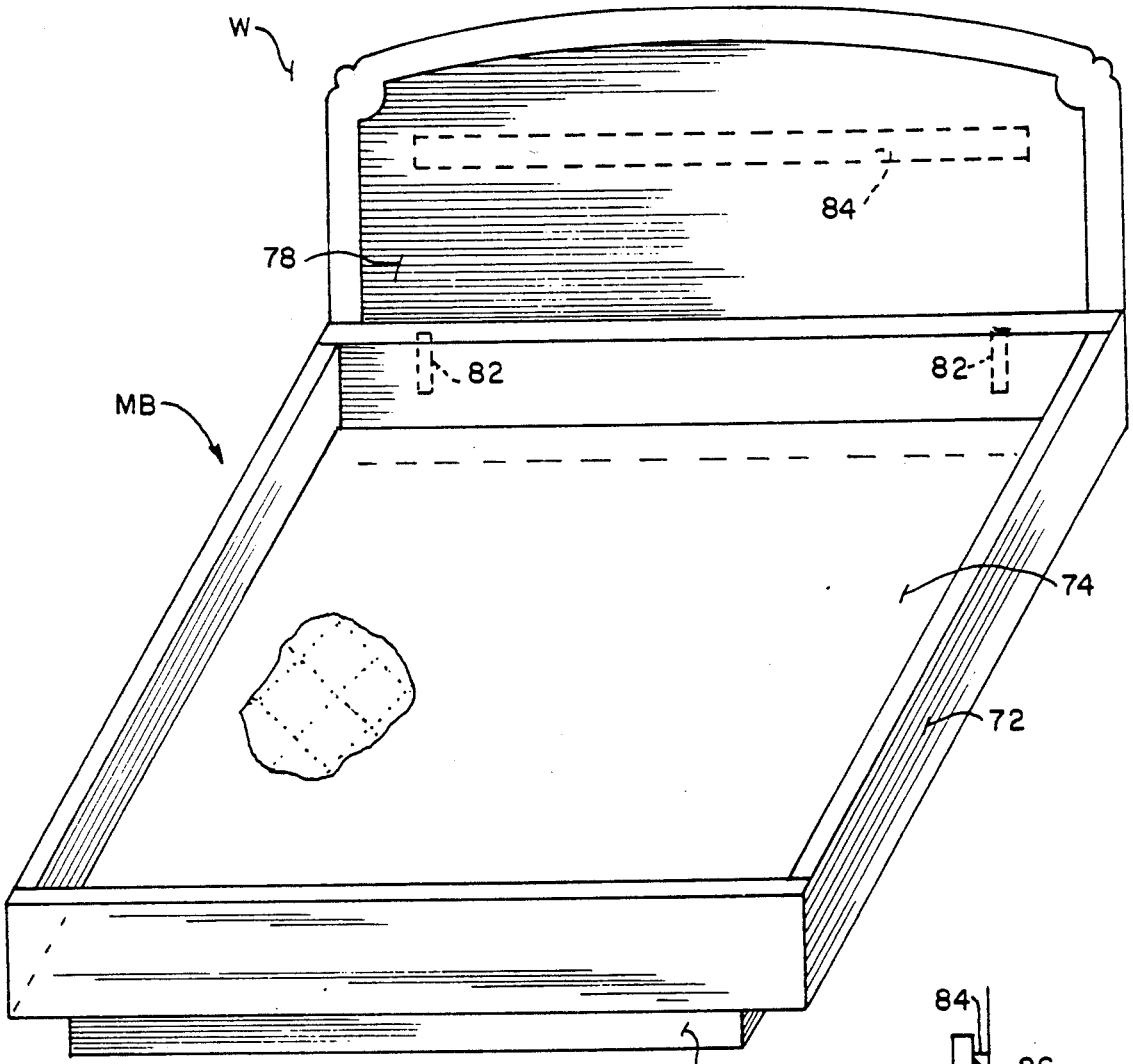
FIG. 23 is a front perspective view of a modular bed system with underlying mattress supporting structure and a headboard.
Figure 24:
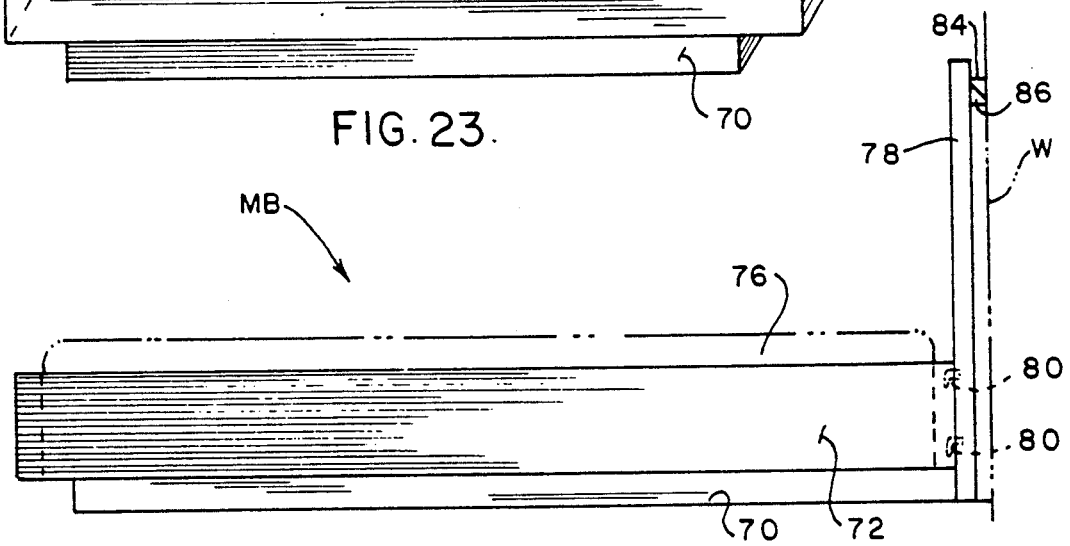
FIG. 24 is a side elevational view of the modular bed system shown in FIG. 23 and illustrating the alternative mounting of the head board to a mattress supporting structure or to an adjacent wall, as desired.

As discussed above, the interchangeable modular furniture system of the present invention may be employed to produce various types of furniture units including credenzas as shown in FIGS. 1-3 and 15 of the drawings; the dresser as shown in FIG. 13 of the drawings; a dresser/cabinet as shown in FIG. 14 of the drawings; a desk as shown in FIGS. 16-19 of the drawings; a bar as shown in FIGS. 20-21 of the drawings; a nightstand as shown in FIG. 22; and a modular bed system as shown in FIGS. 23-24 of the drawings. Each of these various types of furniture units will be discussed in detail in connection with the various figures of the drawings.

Referring first to the credenza unit C as shown in FIGS. 1-3 and 15 of the drawings, in connection with the underlying supporting structure 10 and various component parts thereof as shown in FIGS. 2-12A of the drawings, it will be seen that the underlying supporting structure 10 is a separate and independent base unit to which various component parts are independently and removably attached, in order to form the credenza unit C.

Figure 2:
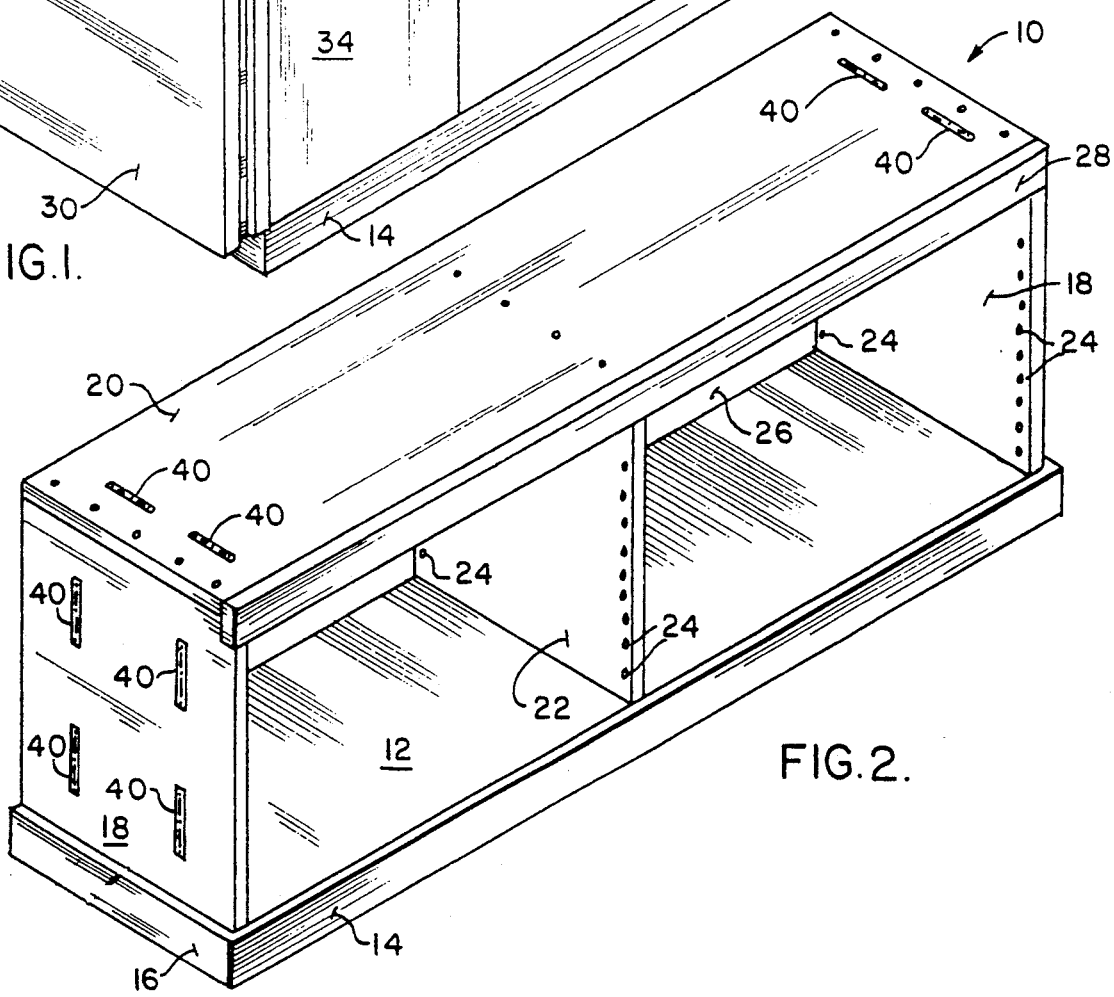
FIG. 2 is a front perspective view of the underlying supporting structure to which various elements including side panels and a top panel are added to produce the credenza unit illustrated in FIG. 1.
Figure 3:
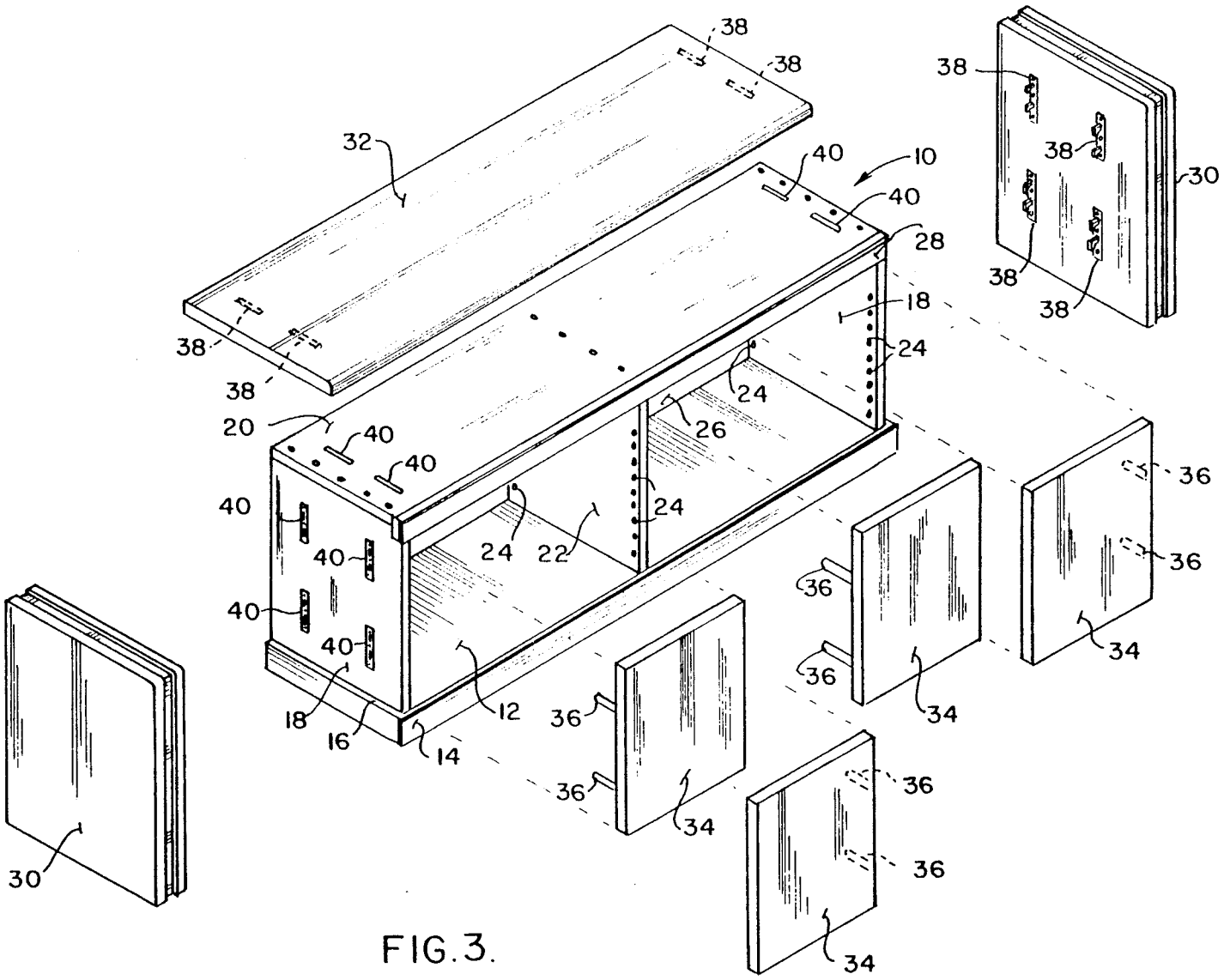
FIG. 3 is an exploded perspective view of the underlying supporting structure together with the various side panels, top panel and other components that form the credenza unit illustrated in FIG. 1 of the drawings.

The underlying supporting structure or base unit 10 is shown in FIGS. 2-3 as being formed in a generally rectangular shape and includes a rectangular base 12 which is fastened or connected to the wrap-around skirt or kick plate 14 that may be formed in one or more pieces, as desired. The upper ledge 16 of the skirt or kick plate 14 forms an underlying ledge 16 for supporting various panels relative to the underlying supporting structure 10, as will be discussed in detail below.

A pair of opposed and spaced side walls 18, 18 are interconnected to and extend upwardly from in a transverse direction from the base 12, as best shown in FIG. 2. A top wall 20 is interconnected to and extends between the opposed and spaced side walls 18, 18, as also illustrated in FIG. 2. The spaced side walls 18 are connected to the base 12 and the top wall 20 is connected to the side walls 18, 18 through the use of nails, as illustrated, or other suitable fastening techniques, as may be desired.

In the underlying supporting structure or base unit 10 as illustrated in FIGS. 2-3 of the drawings, an interior wall 22 is also suitably attached to the base 12 and top wall 20 to facilitate attachment of other component parts to form the credenza unit C, as will be explained below. Note further that each of the spaced side walls 18, 18 and interior wall 22 are provided with a series of vertically aligned holes 24 along inner and outer peripheral edges thereof, for mounting shelves in vertically adjusted positions, as is common.

As illustrated in FIGS. 2-3 of the drawings, the underlying supporting structure or base unit 10 includes an open front, for attachment or mounting of various component parts, i.e., swinging doors, shelves and the like, as disclosed below, to the side walls 18, 18 and interior wall 22. The rear area of the underlying supporting structure 10 is closed off by a rear wall 26 which is connected to base 12, spaced walls 18, 18, interior wall 22, and top wall 20, by suitable fasteners. The rear wall 26 is typically placed up against the room wall, and thus no component parts are directly attached to it in a typical case, although such could be done if desired, as will be understood from the discussion below.

The kick plate or wraparound skirt 14 may be suitably covered with a decorative facing such as a bronze covering or the like. Similarly, the front facia block 28, attached to the spaced walls 18, 18, interior wall 22 and top wall 20, may also be provided with a decorative covering such as a bronze covering as may be desired.

Reference is now made to the FIG. 3 exploded view showing the components of the credenza unit C, including the underlying supporting structure or base unit 10. In accordance with the important teachings of the present invention, as shown in an exploded view of FIG. 3, the interchangeable modular furniture system or construction includes independently mounted panels that are also removably attached to the underlying supporting structure 10.

Figure 1:
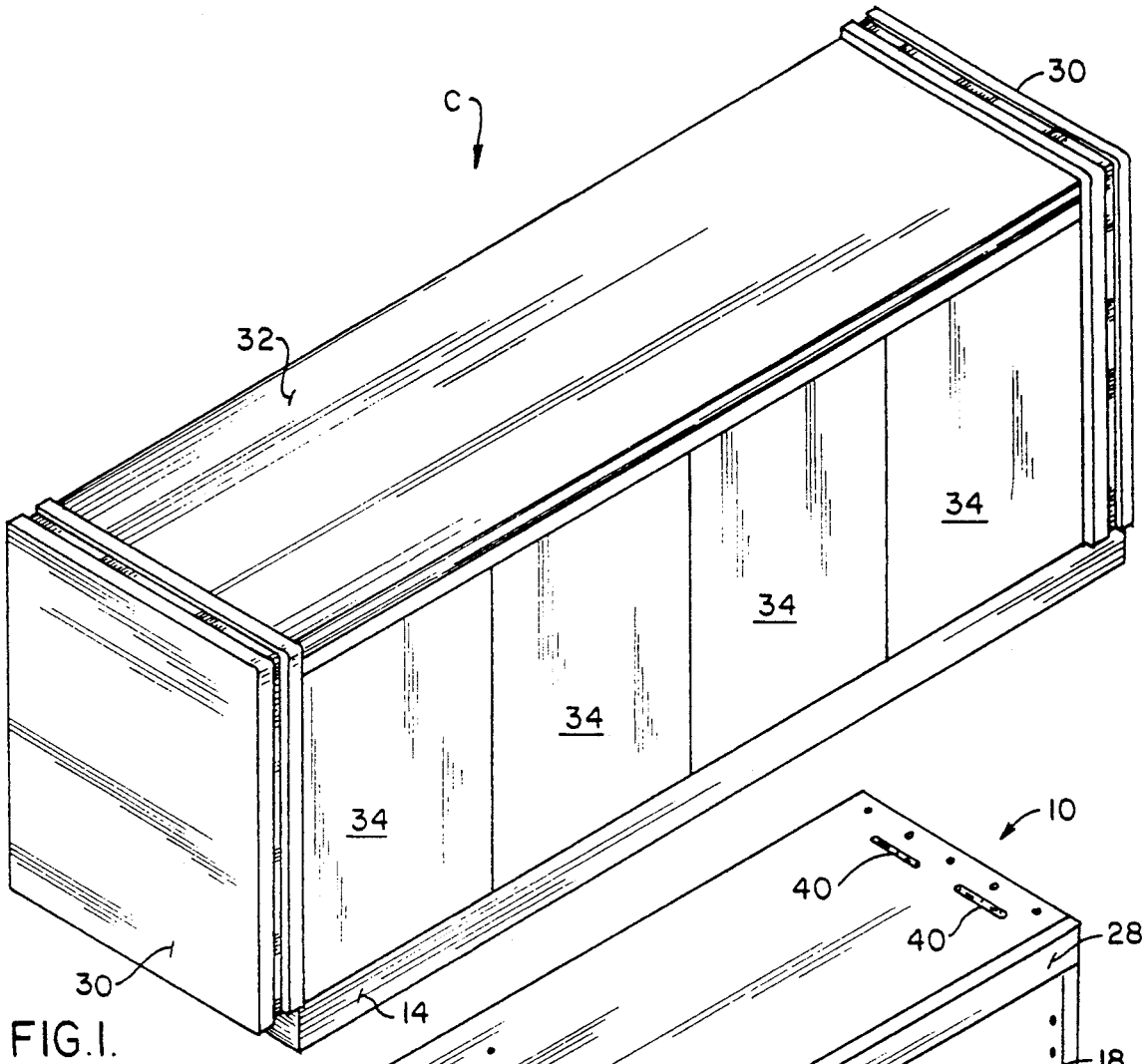
FIG. 1 is a front perspective view of a credenza unit which is constructed with the interchangeable design features of the present invention.

More specifically, for the credenza unit C, there are a pair of panels 30 which are independently and removably mounted to the side walls 18, 18 of the underlying supporting structure 10, through the use of cooperating releasable fastener means, as will be discussed below in connection with FIGS. 4 and FIG. 12A of the drawings. As shown in FIGS. 1 and 3 of the drawings, the side panels 30, 30 are designed and configured to the aesthetic appearance desired, and then are releasably and independently mounted to the side walls 18, 18 of the underlying supporting structure 10. Each of the side panels 30, 30 also rests upon and is supported by the underlying ledge 16 adjacent each side wall 18, 18. Thus, a secure and stable support for each of the side panels 30, 30 relative to the side walls 18, 18 is provided, as will be more fully understood in discussing the cooperating releasable fastening means in connection with FIG. 4 and 12A of the drawings.

In addition to the side panels 30, 30, the credenza unit C includes a top panel 32 which is also releasably and independently mounted relative to the top wall 20 of the underlying supporting structure 10. This is also discussed below in connection with FIGS. 4 and 12A of the drawings. Finally, the credenza unit C includes swinging or pivoting doors that are mounted to inside surfaces of the side walls 18, 18 and on opposite surfaces of the interior wall 22, by way of the pivoting hinge mounts 36, 36., which are attached to each of the pivoting doors 34, as shown in FIG. 3 of the drawings When each of the side panels 30, 30, top panel 32 and doors 34 are attached to the underlying supporting structure 10, the credenza unit C shown in FIG. 1 of the drawing results. If any of the side panels 30, 30, top panel 32 or doors 34 become damaged, as discussed above, they may be simply replaced, by removing and replacing each panel or component at the user's location, without removing the entire credenza C, as is presently done. It will also be apparent that if the user desires to change the entire design of the credenza unit C by replacing the side panels 30, 30, top panel 32 and doors 34 with corresponding panels and doors that have an entirely different lock and appearance, this may be easily accomplished. As a result, the underlying supporting structure or base unit 10 serves as the permanent unit, while one or more of the side panels 30, 30, top panel 32 and doors 34 may be changed for repair purposes, and even for changing the entire design appearance of the credenza unit C, if desired.

Referring now to the cooperative releasable fastening means for attaching the various side panels 30, 30 and top panel 32 relative to the corresponding side walls 18, 18 and top wall 20 of the underlying supporting structure 10, it will be seen in FIGS. 4–12A that there are two types of cooperative releasable fastening means disclosed. The first type is shown in FIGS. 4–7, as well as FIGS. 2–3, while the second type is illustrated in FIGS. 8–12A.

Figure 4:
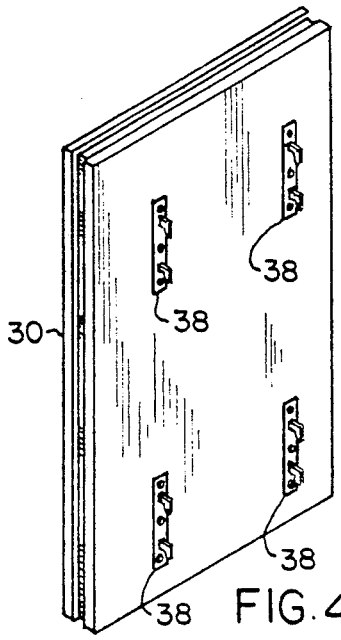
FIG. 4 is an enlarged perspective view of the inside of one of the side panels illustrating releasable fastening elements attached thereto.
Figure 5:
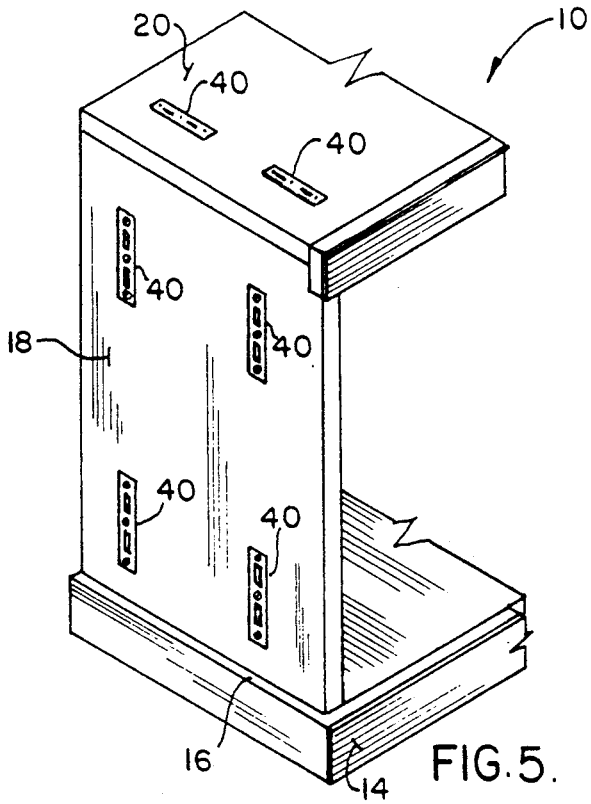
FIG. 5 is an enlarged fragmentary perspective view of an associated side wall to which the side panel shown in FIG. 4 is mounted, and further including cooperating releasable fastener elements for releasable interconnection with the side panel releasable fastener elements shown in FIG. 4 of the drawings.
Figure 6:
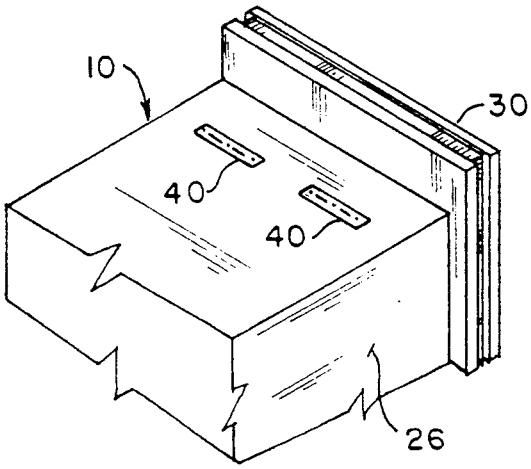
FIG. 6 is a fragmentary perspective view of the manner in which the side panel is mounted to the underlying supporting structure of FIGS. 2–3, prior to the top panel being mounted thereon.
Figure 7:
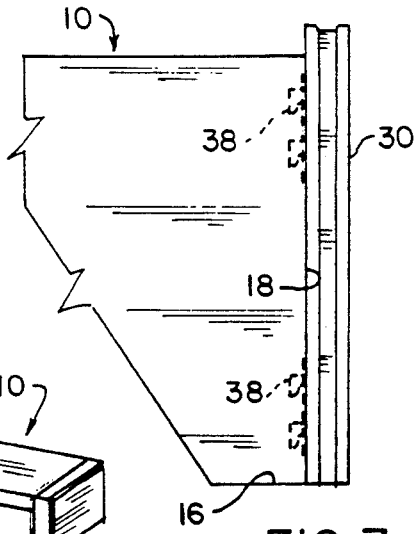
FIG. 7 is a fragmentary side elevational view, partially in hidden lines, illustrating the cooperative interconnection between the releasable fastening elements of the side panel and associated side wall of the underlying supporting structure.

Referring first to the cooperative releasable fastening means shown in FIGS. 4–7 and FIGS. 2–3, it will be seen that the cooperative releasable fastening means shown is what is commonly known as hook and slot fastener elements provided on the associated side panel and side wall 30, 18, as well as on the top panel and top wall 32, 20. As best shown in FIGS. 4–5 of the drawings, each side panel 30 is provided with laterally and longitudinally spaced pairs of hook elements 38 that are in cooperative releasable and interlocking engagement with corresponding laterally and longitudinally spaced pairs of slot elements 40 that are provided on each side wall 18, for releasable and interlocking engagement therewith. For mounting each side panel 30 relative to an associated side wall 18, it is a relatively simple matter to position the cooperating pair of hook element 38 of one side panel 30 relative to cooperating slot means 40 of one side wall 18, in order to allow each cooperating pair of hook elements 38 to engage interior surface areas adjacent to and immediately below each slot, such that the cooperating pairs of hook slot elements 38, 40 are releasably interconnected relative to one another. FIGS. 6–7 show a side panel 30 mounted to a respective side wall 18, prior to the mounting of the top panel 32. FIG. 7 also illustrates the manner in which the hook portions 38 engage surface areas adjacent to and below each pair of cooperating slots 40.

To further assist in supporting each side panel 30 relative to side wall 18, the underlying ledge 16 engages a lower surface or edge of the side panel 30 for supporting each side panel 30 relative to a respective side wall 18.

The top panel 32 is mounted to the top wall 20 of the underlying supporting structure 10 in a similar manner. Thus, the lower surface of the top panel 32 is provided with laterally and longitudinally align cooperating pairs of hook elements 38 for releasable cooperative interlocking engagement relative to the corresponding laterally and longitudinally aligned slot elements 40. Thus, it is a simple matter to align the cooperating hooks and slot fastener elements 38, 40 in assembling top panel 32 relative to the top wall 20, and thereafter slightly shift the top panel 32 relative to the hook elements for underlying engagement relative to the inner wall areas adjacent to each of the cooperating pairs of slots 40, in a similar manner to that shown in FIG. 7 of the drawings.

It will be appreciated that the side panels 30 and associated side walls 18 may have the hook and slot elements reversed such that the hook elements would be mounted on the side wall 18 and the slot elements mounted on the side panel 30, as will be appreciated.

Figure 8:
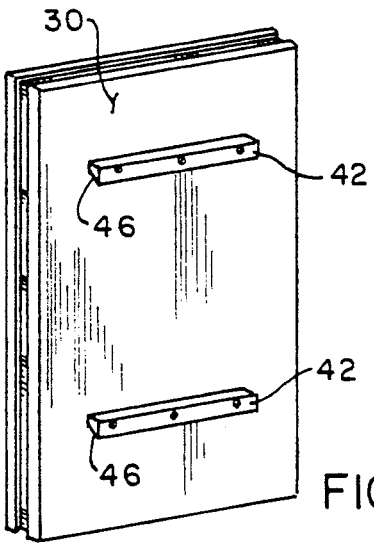
FIG. 8 is an enlarged perspective view illustrating the inside surface of a side panel with the cooperative releasable fastening elements formed as cooperating elongated elements.
Figure 9:
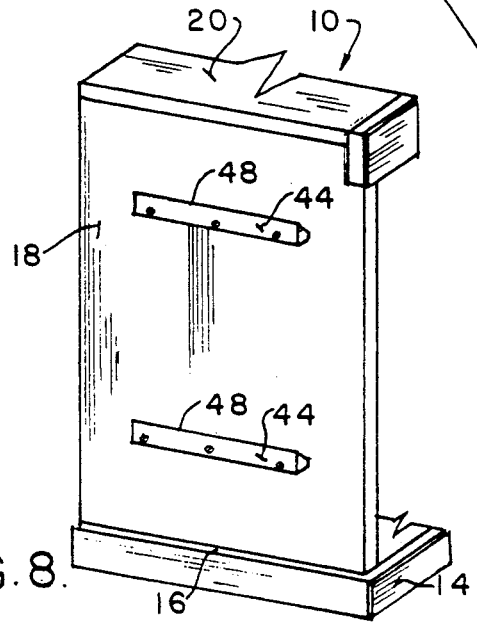
FIG. 9 is a fragmentary front perspective view of the underlying supporting structure illustrating cooperating elongated elements provided on the associated side wall for overlapping and mating interlocking engagement with the cooperating elongated elements of the side panel shown in FIG. 8 of the drawings.
Figure 10:
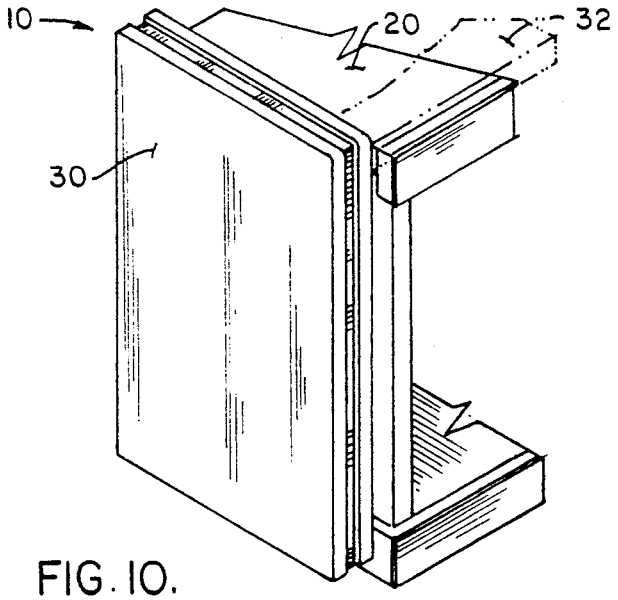
FIG. 10 is a fragmentary front perspective view illustrating a side panel mounted relative to a credenza unit, from a different vantage than the illustration of FIG. 6.
Figure 11:
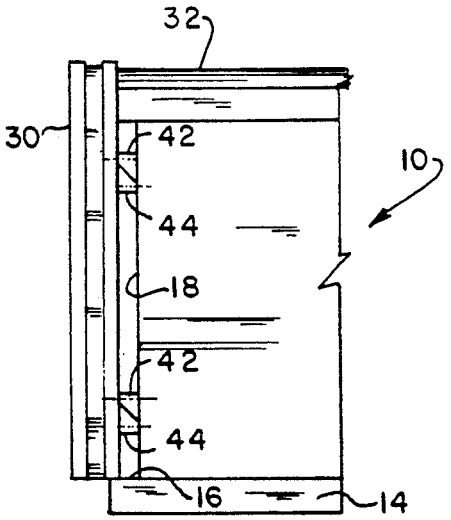
FIG. 11 is a side view illustrating the overlapping and mating interlocking engagement between the cooperating elongated elements of the side panel and associated side wall as shown in FIGS. 8–9 of the drawings.
Figure 12:
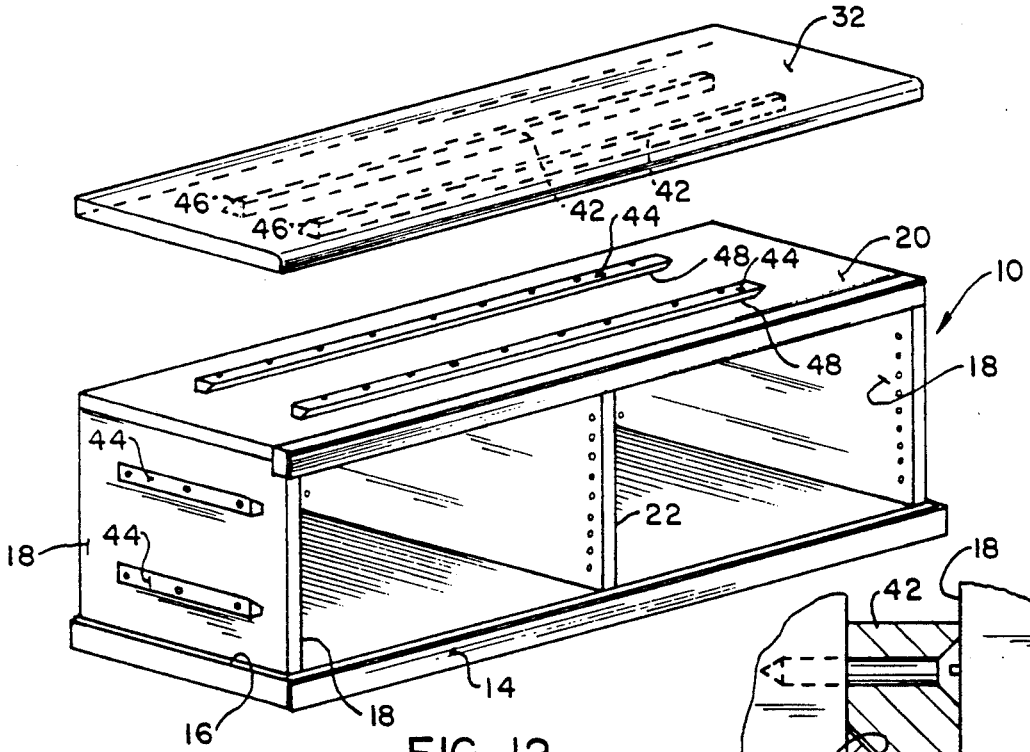
FIG. 12 is an exploded front perspective view showing cooperating elongated elements between a top panel and top wall of the underlying supporting structure for overlapping and mating interlocking engagement with one another.
Figure 12A:
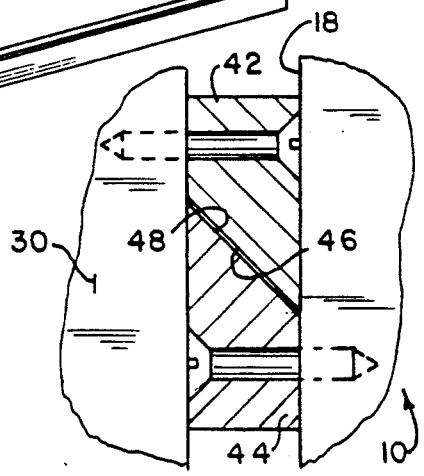
FIG. 12A is an enlarged fragmentary sectional view illustrating the overlapping and meeting interlocking engagement between cooperating elongated elements of an adjacent panel and wall of the underlying supporting structure.

Referring now to the second type of cooperative releasable fastening means illustrated in the drawings, reference is made to FIGS. 8–12A of the drawings. Referring first to FIGS. 8–9 and FIG. 12A, it will be seen that each side panel 30 and associated side wall 18 are provided with upper and lower pairs of cooperating elongated elements 42 and 44. The tapered under surface 36 of each cooperating upper and lower pair of elongated elements 42 attached to the side panel is designed to overlap and mate with the upper tapered surface 48 of each cooperating elongated elements 44 attached to the side wall 18. Assembly is quite easy by simply aligning cooperating upper and lower pairs of elongated elements 42, attached to the side panel 30, with the cooperating pair of upper and lower elongated elements 44 attached to the side wall 18, enabling the tapered under surface 46 of the cooperating elongated elements 42 to be positioned in mating and overlapping engagement relative to the tapered upper surface 48 of each of the cooperating upper and lower pair of elongated elements 44. Again, the side panel may rest on the underlying edge 16 formed from the skirt 14, if desired FIG. 12A illustrates the overlapping and mating engagement of the tapered upper surface 46 of each elongated element 42 with the downwardly and inwardly tapering upper surface 48 of each cooperating element 44, for cooperative releasable engagement therewith.

FIGS. 10–11 illustrate the manner in which side panel 30 is mounted to the side wall 18 of the underlying supporting structure 10, with FIG. 11 further illustrating the upper and lower cooperating pairs of elongated elements 42 of the side panel 30 being positioned in mating and overlapping engagement relative to the cooperating elongated elements 44 attached to the side wall 18 of the elongated structure.

In the same manner, top panel 32 is mounted to the top wall 20 of the underlying supporting structure of base unit 10 with the cooperating elongated elements 42 attached to the top panel 32 being positioned in overlapping and mating engagement relative to the cooperating elongated elements 44 attached to the top wall 20, through the corresponding tapered interlocking surfaces 46, 48, as will be now understood By allowing the side panels 30, 30 and top panel 32 to be mounted independently relative to the underlying supporting structure or base unit 30, they become individual units which can be independently replaced without replacing the entire credenza unit C. Also, the independent or floating mounting enables the side panels 30, 30 and top panel 32 to adjust for changes in temperature, pressure and humidity, when the credenza unit C is shipped to various parts of the country. The removable or releasable mounting of the side panels 30, 30 and top panel 32 relative to the underlying supporting structure or base unit 10 further affords quick, efficient and economical replacement of the component parts, without replacing the entire credenza unit C.

The various types of releasable cooperative fastening means, illustrated in FIGS. 4–12A of the drawings, are preferred examples, although various other types of fastening units may also be employed, if desired. Typically, once each respective side panel 30 or top panel 32 is mounted to an associated side wall or top wall 20, locking screws may be used to drive through the side wall 18 and top wall 20 of the underlying supporting structure or base unit 10 to tack or fix same relative to the underlying supporting structure of base unit 10. It is quite easy to remove the locking screws, thus allowing the removable side and top panels 30 and 32 to be quickly and easily removed from the side wall and top wall 18, 20 of the underlying supporting structure of base unit 10, when desired.

Figure 15:
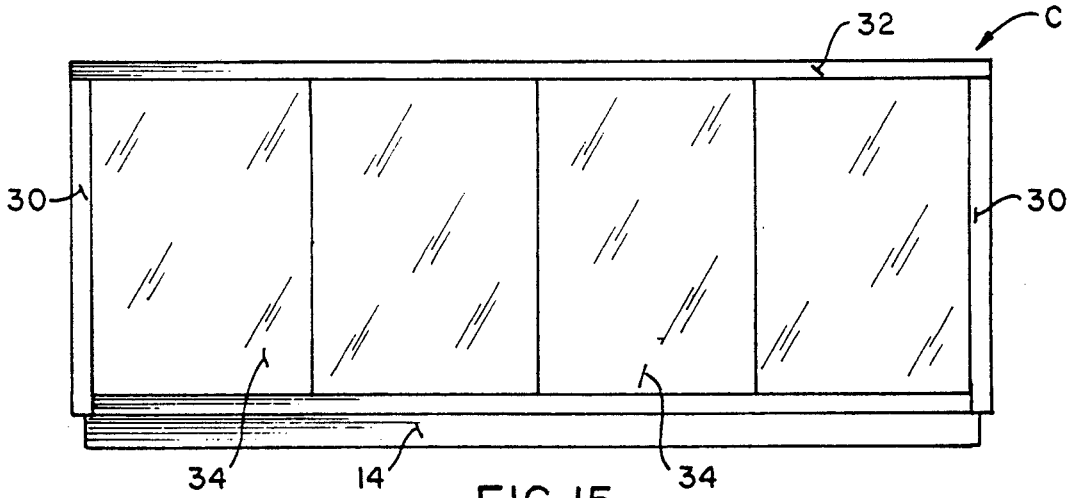
FIG. 15 is a front elevational view of the credenza unit illustrated in FIG. 1 of the drawings which is constructed from the underlying supporting structure shown in FIG. 2 of the drawings.

Referring now to FIGS. 13–15 of the drawings, it will be seen that the underlying supporting structure 10 may not only be used to produce a credenza unit C, but also a dresser D or a dresser/cabinet DC. In FIG. 15 of the drawings, the credenza unit C is shown in front elevational view with the opposed side panels 30, top panel 32 and swinging doors 34 mounted to the underlying supporting structure or base unit 10, as described in connection with FIGS. 1–3 of the drawings. In lieu of the swinging doors 34, a triple dresser unit D containing drawers 50 may also be formed from the underlying supporting structure of base unit 10. Note that opposed side panels 30, 30 and top panel 32 are independently removably secured to the underlying supporting structure of base unit 10, in the same manner as the credenza unit C of FIG. 15. However, the triple dresser unit D of FIG. 13 has three sets of three drawers each for at total of nine drawers 50 within the open front of the underlying supporting structure or base unit. For this purpose, a pair of interior walls 22 may be desired in order to mount the drawers slides (not shown) for supporting in the nine drawers in the configuration shown in FIG. 13 of the drawings.

Another variation as shown in FIG. 14 of the drawing where a dresser/cabinet unit DC is illustrated. In this instance, there are two outer rows of three drawers 50 comprising a total of six drawers and two swinging drawers 34, 34 comprising the dresser cabinet unit DC illustrated in FIG. 14. In this case also, a pair of interior walls 22 may be desired for mounting the drawers 50 and swinging doors 34 in the manner illustrated in FIG. 14 of the drawings.

It will be appreciated that other variations may be used informing a variety of different types and kinds of swinging doors, drawers or other structure in the open front area of the underlying supporting structure or base unit 10, as may be desired.

Reference is now made to various other types of furniture which may incorporate the interchangeable modular design features of the present invention. FIGS. 16–19 show a desk unit DK; FIGS. 20–21 illustrate a bar unit B; FIG. 22 illustrates a nightstand N; and FIGS. 23–24 illustrate an interchangeable modular bed unit B.

Figure 16:
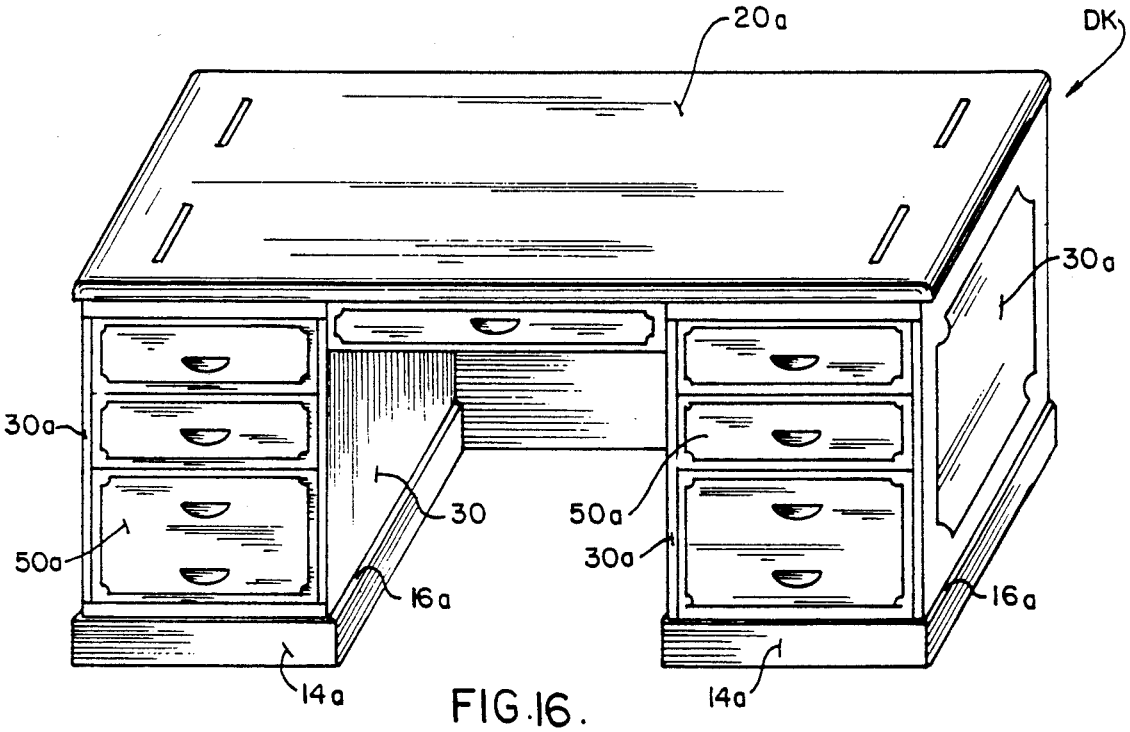
FIG. 16 is a front perspective view of a desk with included interchangeable design features of the present invention.
Figure 17:
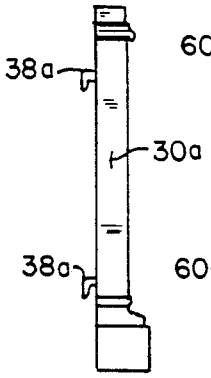
FIG. 17 is a side elevational view of the desk side panel with releasable fastening elements for attachment to one of the side walls of the underlying supporting structure.

Referring first to the desk unit DK illustrated in FIGS. 16–19 of the drawings, it will be seen in FIG. 19 that the underlying supporting structure or base unit 10*a* includes spaced pairs of spaced side wall sections 52, 52 each having a pair of spaced side walls 18*a*, 18*a* and a series of horizontal dividers 54, 54 to receive drawer 50. For interconnecting the two spaced pairs of spaced side wall sections 52, 52, a top wall 28 extends therebetween, as illustrated in FIG. 19. With a desk unit DK underlying supporting structure or base unit 10A so constructed, it is now possible to independently and removably mount inner and outer desk side panels 30A, 30A to each of the spaced side walls 18*a*, 18*a* of the spaced side wall sections 52, 52, as illustrated in FIGS. 16. In this regard, it is to be noted that the outer side panel 30*a* shown in FIG. 17 of the drawing is provided with cooperating releasable hook element 38*a*, 38*a* for cooperative releasable and interlocking engagement with corresponding slot elements formed in the outer side walls 18*a*, as will be understood. The inner side panels 30*a* shown in FIG. 16 are mounted in the same way as the outer side panels 30*a*, except that the design configuration may be plain instead of having the sculptured appearance illustrated in FIGS. 16–17. In both the inner and outer side panels 30*a*, 30*a*, note that the underlying edge 16*a* of the skirt 14*a* provides further underlying support for the outer and inner side panels 30*a*, 30*a*.

Although the top panel of the desk unit DK is not shown in FIG. 16 of the drawings, it will be understood that the top desk panel will be mounted to the top wall 20*a* of the underlying supporting structure or base unit 10*a* in the same manner as the credenza unit shown in FIGS. 1–3 of the drawings, utilizing the cooperating releasable slot fastener elements, if desired. Of course, other types of fastening element may be used, such as shown in other figures of the drawings, or as further explained herein.

Each of the drawers 50 may be provided with a removable outer drawer panel, if desired, for replacing the outer drawer panels, much in the same way as the inner and outer side panels 30*a*, 30*a* and the top panel (not shown).

FIG. 18 shows a rear wall panel 56, which is mounted over the rear wall of each of the spaced side wall sections 52, 52, and an intermediate wall panel 58 that is attached to each of the rear wall panels 56. In this regard, each of the rear wall panels 56 include cooperating releasable interlocking elements, similar to the inner and outer side panels 30*a*, 30*a*, for releasable interlocking engagement to the rear walls (not shown) of each of the side wall sections 52, 52. The intermediate or privacy panel 58 is illustrated in FIG. 18 as having cooperative releasable hook and slot interlocking fastening elements 60, 62 for releasable interlocking engagement with each of the rear wall panels 56, 56, as illustrated.

It will now be understood, the desk unit DK can have the inner and outer panels 30*a*, 30*a*, top panel (not shown), rear panels 56, 56, intermediate panel 58 and the drawer panel sections of drawers 50 replaced for repair purposes or to change the entire design appearance of the desk unit DK by employing different panels and panel section designs.

Referring now to the bar unit B illustrated in FIGS. 20–21 of the drawings, it will be seen that it is necessary to modify the underlying supporting structure or base unit B such that there is an open rear wall and a closed front wall, as compared to the credenza unit C where there is an open front wall and a closed wall. In this regard, it will be noted in FIG. 21 that there are series of horizontal shelves 64, 64 extending between the spaced side walls 18*b*, 18*b* of the underlying supporting structure or base unit 10*b* for supporting and storing various objects in the bar unit B, as will be understood. The side panels 30*b*, 30*b* and top panel 32*b* are attached to the corresponding spaced side walls 18*b*, 18*b* and top wall (not shown) of the underlying supporting structure or base unit 10*b* in much the same manner as the various types of furniture units illustrated in FIGS. 13–15 of the drawings. In this particular instance; however, since the front wall is closed, a series of separate panel sections 66, 66, 66 may be juxtaposed relative to one another and attached to the closed front wall panel 68 illustrated in FIG. 21 of the drawings, through the use of similar releasable cooperative fastening elements such as shown in FIGS. 4–12A of the drawings. Although a single front panel may be used, in this instance, a series of panel sections 66, 66, 66 are employed to cover the closed front wall 68 of the underlying supporting structure or base unit 10*b*, to thus show the additional versatility of the interchangeable modular design system or construction of the present invention.

The nightstand unit N illustrated in FIG. 22 of the drawings shows a construction somewhat similar to the completed side wall sections 52 of the desk unit DK. In this regard, the nightstand unit N includes opposed side panels 30*c*, 30*c* and a top panel 32*c*, together with drawers 50*c* mounted in the open front (not shown) of the underlying supporting structure or base unit (not shown). In the same manner as the other furniture units, repair and replacement of various side and top panels, as well as panel sections attached to the outer front of each of the drawers 50*c* can be quickly and easily accomplished, as will now be understood.

Referring now to the interchangeable modular bed unit MB illustrated in FIGS. 23–24 of the drawings, it will be seen that there is an underlying mattress supporting structure including a base or kick plate 70, a rectangular shaped outer supporting wall 72 and an inner support 74. The rectangular supporting wall 72 and inner mattress support member 74 are themselves supported by the kick plate or base 70. Mattress 76 is illustrated in phantom lines in FIG. 24 of the drawings for reception within the rectangular shaped mattress supporting wall 72.

The interchangeable modular bed unit MB further includes a headboard 78 which is removably mounted relative to the underlying mattress supporting structure 70, 72 and 74 or to an adjacent wall W. In this regard, it will be noted that the headboard 78 includes fastener elements (FIG. 24) for releasable cooperative engagement with the slot fastener elements 82, shown in dotted lines in FIG. 23 of the drawings. In addition, the headboard 78 is provided with a cooperating elongated element 84 for mating and overlapping engagement relative to a cooperating elongated element 86 attached to the wall W, as illustrated in FIG. 24 of the drawings. Alternatively, hook and slot fastener releasable engaging means could be employed, if desired.

The interchangeable modular bed unit MB illustrated in FIGS. 23–24 thus enables the headboard 78 to be removably mounted to a wall W, by use of the cooperating elongated elements 84, 86, as illustrated. In some circumstances, motel and hotel owners do not desire attachment of the headboard 78 to a wall. In such a case, it is a relatively simple matter to mount the headboard 78 to the mattress surrounding wall 72 via the cooperating hook and slot fasteners 80, 82 or other suitable fastening means. Thus, the headboard 78 may be mounted relative to an adjacent wall W as well as to the surrounding mattress wall 72, as illustrated, or alternatively, the headboard 78 may be mounted to an adjacent wall W with the mattress surrounding wall 72 being positioned in close proximity to the headboard 78, or the headboard 78 may be mounted to the surrounding mattress wall 72, with the headboard 78 positioned in close proximity to an adjacent wall W. This affords a variety of options for a variety of different situations.

From the foregoing, it will now been appreciated that the interchangeable modular furniture system of construction of the present invention provides a novel and unique approach not heretofore contemplated by the prior art which further overcomes and solves all of the long standing problems that have constantly plagued the furniture industry, motels and hotels, as well as commercial, institutional and residential users. A variety of different furniture pieces can be produced as a result of the interchangeable modular furniture system or construction of the present invention including those described and illustrated herein, as well as other different types of furniture pieces or units, as will be apparent.

In view of the above, it will be seen that the several objects and features of this invention are achieved and other advantageous results obtained.

As various changes could be made in the above constructions without departing from the scope of the invention, it is intended that all matter contained in the above description or shown in the accompanying drawings shall be interpreted as illustrative and not in a limiting sense.

I claim:

1. An interchangeable modular furniture system for quick repair or replacement of independently mounted panels comprising:

an underlying supporting structure having at least spaced side walls, a top wall and a base interconnected to said side walls;

said independently mounted panel means being independently and removably mounted to at least the side walls of the underlying supporting structure;

said panel means and its associated wall each having cooperating laterally and longitudinally aligned and spaced pairs of quick release fastening means for releasable engagement with one another to facilitate removal for repair or replacement of said panel means relative to its associated wall, the laterally and longitudinally aligned and spaced pairs of quick release fastening means on said panel means being similarly constructed for cooperative releasable fastening engagement and disengagement with complementary similarly constructed laterally and longitudinally aligned and spaced pairs of quick release fastening means on its associated wall, said cooperating laterally and longitudinally aligned and spaced pairs of quick release fastening means on both said panel means and its associated wall being positioned for substantially simultaneous releasable fastening engagement and disengagement when said panel means is in generally adjacent and parallel confronting position relative to its associated wall, in order to facilitate substantially simultaneous engagement and disengagement of said cooperating quick release fastening means on said panel means and its associated wall to provide quick assembly or removal for repair or replacement of the panel means relative to its associated wall; and said base including an underlying ledge adjacent each spaced side wall that supports each removable panel means relative to its associated side wall when the cooperative releasable fastening means are releasably engaged with one another, said underlying ledge providing underlying support beneath each said panel means to assist the cooperative releasable fastening means in holding the panel means in fixed and proximate relationship to an associated side wall.

2. The modular furniture construction as defined in claim 1 wherein said panel means comprises a single panel mounted to and covering at least one of the walls of the underlying supporting structure.

3. The modular furniture construction as defined in claim 1 wherein said panel means comprise a series of panel sections for covering at least one of the walls of the underlying supporting structure.

4. An interchangeable modular furniture system comprising:

an underlying supporting structure having at least spaced side walls, a top wall and a base interconnected to said side walls;

removable panels independently mounted to and covering at least the side walls of the underlying supporting structure;

laterally and longitudinally aligned and spaced pairs of quick release fastening means for releasable engagement with one another to facilitate the removal for repair of replacement of said panel means and its associated wall each having cooperating releasable fastening means for releasable engagement with one another, said cooperating laterally and longitudinally aligned and spaced pairs of releasable fastening means being positioned for substantially simultaneous releasable fastening engagement and disengagement when said panel means is in generally adjacent and parallel confronting position relative to its associated wall, in order to facilitate substantially simultaneous engagement and disengagement of said cooperating quick release fastening means on said panel means and its associated wall to provide quick removal and replacement of the panel means relative to its associated wall, the laterally and longitudinally aligned and spaced quick release fastening means on said panel means being simultaneously constructed for cooperative releasable fastening engagement and disengagement with complementary similarly constructed laterally and longitudinally aligned and spaced pairs of quick release fastening means on its associated wall in order to facilitate substantially simultaneously engagement and disengagement of said cooperatively quick release fastening means one each said panel means and its associated wall; and said base including an underlying ledge adjacent each spaced side wall that supports each removable panel relative to its associated side wall when the cooperative releasable fastening means are releasably engaged with one another, said underlying ledge providing underlying support beneath each said panel to assist the cooperative releasable fastening means in holding the panel in fixed and proximate relationship to its associated side wall.

5. The interchangeable modular furniture system as defined in claim 4 wherein the underlying supporting structure includes a rear wall and an open front opposing the rear wall, at lest one interior wall extending between the rear wall and open front, and means between the at least one interior wall and spaced side walls for supporting and storing various objects within the underlying supporting structure.

6. The interchangeable modular furniture system as defined in claim 5 wherein said means comprises supporting shelves mounted between the at least one interior wall and spaced side walls.

7. The interchangeable modular furniture system as defined in claim 5 wherein said means comprises drawers mounted between the at least one interior wall and spaced side walls.

8. The interchangeable modular furniture system as defined in claim 5 wherein said means comprises drawers and pivoting doors mounted between the at least one interior wall and spaced side walls.

9. The modular furniture system as defined in claim 5 and including pivoting doors mounted to the interior wall and spaced side walls between an open position exposing the open front and a closed position covering the open front.

10. The interchangeable modular furniture system as defined in claim 4 wherein the underlying supporting structure includes a front wall and an open rear wall opposing the front wall, a removable panel independently mounted to the front wall of the underlying supporting structure, and means between the spaced side walls for supporting and storing various objects within the underlying supporting structure.

11. The interchangeable modular furniture system as defined in claim 4 wherein the underlying supportive structure includes a rear wall and an open front opposing the rear wall, and means mounted with respect to said spaced side walls for closing off the open front of the underling supporting structure.

12. The interchangeable modular furniture system as defined in claim 11 including a removable panel independently mounted to at least part of said last mentioned means for covering at least part of the open front of the underlying supporting structure.

13. The interchangeable modular furniture system as defined in claim 4 wherein said underlying supporting structure includes at least two spaced paris of spaced side wall sections interconnected by a top wall extending therebetween, a rear wall for each pair of spaced side wall sections, an open wall opposing each of the rear walls, and drawers mounted within and closing off the open walls of each pair of spaced side wall section.

14. The interchangeable modular furniture system as defined in claim 13 including removable panels mounted to each of the rear walls of each pair of spaced side wall sections, and a removable panel mounted to the removable panels mounted to each of the rear walls.

15. The interchangeable modular furniture system as defined in claim 14 including removable panel sections mounted to each of an outer face of each of said drawers.

16. An interchangeable modular furniture system comprising:

an underlying supporting structure including at least a base, opposed and spaced side walls interconnected to and extending from the base, and a top wall interconnected to and extending between the opposed spaced side walls;

a side panel independently and removably mounted to each of the opposed and spaced side walls of the underlying supporting structure;

each side panel and its associated side wall having laterally and longitudinally aligned and spaced pairs of cooperating releasable fastening means for releasable engagement with one another, said cooperating releasable fastening means being positioned for substantially simultaneous releasable engagement and disengagement when each said side panel is in generally adjacent and parallel confronting position relative to its associated side wall;

a top panel independently and removably mounted to the top wall of the underlying supporting structure;

said top panel and its associated top wall having laterally and longitudinally aligned and spaced pairs of cooperating releasable fastening means for releasable engagement with one another, said cooperating releasable fastening means being positioned for substantially simultaneous releasable engagement and disengagement when said top panel is in generally adjacent and parallel confronting position relative to its associated top wall; and said base including an underlying ledge adjacent each spaced side wall that supports each removable panel relative to an associated side wall when the cooperating releasable fastening means on each side wall and its associated side wall are releasably engaged with one another, said underlying ledge providing underlying support beneath each side panel to assist the cooperative releasable fastening means in holding each side panel in fixed and proximate relationship to an associated side wall.

17. The interchangeable modular furniture system as defined in claim 16 wherein said cooperating releasable fastening means include hook and slot fastener elements provided on each side panel and respective side wall.

18. The interchangeable modular furniture system as defined in claim 17 wherein said cooperating hook and slot fastener elements include cooperating pairs of hook and slot fastener elements.

19. The interchangeable modular furniture system as defined in claim 18 including laterally and longitudinally spaced pairs of cooperating pairs of hook and slot fastener elements.

20. The interchangeable modular furniture system as defined in claim 16 wherein said cooperating releasable fastening means includes cooperating elongated elements provided on each side panel and respective side wall which are constructed for overlapping and mating interlocking engagement when engaged with one another.

21. The interchangeable modular furniture system as defined in claim 20 wherein each side panel and associated side wall have upper and lower pairs of cooperating elongated elements.

22. The interchangeable modular furniture system as defined in claim 16 wherein the top panel is also releasably attached to the top wall of the underlying supporting structure.

23. The interchangeable modular furniture system as defined in claim 22 wherein the top panel and top wall include cooperating releasable fastening means for releasable attachment to one another.

24. The interchangeable modular furniture system as defined in claim 23 wherein the top panel and top wall cooperating releasable fastening means include cooperating hook and slot fastener elements provided on the top panel and top wall.

25. The interchangeable modular furniture system as defined in claim 24 wherein said cooperating pairs of hook and slot fastener elements include cooperating pairs of hook and slot fastener elements.

26. The interchangeable modular furniture system as defined in claim 25 and including laterally and longitudinally spaced pairs of cooperating pairs of hook and slot fastener elements.

27. The interchangeable modular furniture system as defined in claim 23 wherein said cooperating releasable fastening means includes cooperating elongated elements provided on the top panel and top wall which are constructed for overlapping and mating interlocking engagement when engaged with one another.

28. The interchangeable modular furniture system as defined in claim 27 wherein there are pairs of cooperating elongated elements provided on the top panel and top wall.

* * * * *

UNITED STATES PATENT AND TRADEMARK OFFICE

CERTIFICATE OF CORRECTION

PATENT NO. : 5,176,435

DATED : January 5, 1993

INVENTOR(S) : Donald R. Pipkens

It is certified that error appears in the above-identified patent and that said Letters Patent is hereby corrected as shown below:

Claim 5, Column 13, Line 64 is "at lest one",
should be -- at least one -- and

Claim 13, Column 14, Line 39 is "two spaced paris",
should be -- two spaced pairs --.

Signed and Sealed this

Sixteenth Day of November, 1993

*Attest:*

BRUCE LEHMAN

*Attesting Officer*

*Commissioner of Patents and Trademarks*